United States Patent [19]

Steibing et al.

[11] 4,154,304

[45] May 15, 1979

[54] FIRE EXTINGUISHER NOZZLE

[76] Inventors: Henry Steibing, 1417 Roberts Ave.; Joseph Marchese, 578 Hayes St., both of Hazleton, Pa. 18201

[21] Appl. No.: 851,511

[22] Filed: Nov. 14, 1977

[51] Int. Cl.[2] ..... A62C 35/32

[52] U.S. Cl. ..... 169/74; 239/548

[58] Field of Search ..... 239/548, 556–558, 239/560, 561, 390, 391; 169/30, 71, 74, 89

[56] References Cited

U.S. PATENT DOCUMENTS

| | | | |
|---|---|---|---|
| 2,950,762 | 8/1960 | Austin | 169/89 |

FOREIGN PATENT DOCUMENTS

| | | | |
|---|---|---|---|
| 625475 | 2/1936 | Fed. Rep. of Germany | 239/548 |
| 756889 | 10/1954 | Fed. Rep. of Germany | 169/30 |
| 224907 | 3/1943 | Switzerland | 239/558 |
| 3707 of | 1894 | United Kingdom | 169/74 |

*Primary Examiner*—Robert B. Reeves
*Assistant Examiner*—Andres Kashnikow
*Attorney, Agent, or Firm*—Kenyon & Kenyon, Reilly, Carr & Chapin

[57] ABSTRACT

An improved nozzle for a portable air/water fire extinguisher which includes a head portion having a plurality of small openings to result in a fog spray permitting better fire extinguishing and longer operating times for the extinguisher.

9 Claims, 4 Drawing Figures

11
13
15
17
19
21
23
23b
24
25
27
29
31
33
35
37
39

FIRE EXTINGUISHER NOZZLE

This invention relates to fire fighting in general and, more particularly, to an improved nozzle for use on a portable liquid containing fire extinguisher.

As is known, two of the basic conditions required if a fire is to burn are that the burning material be maintained at its combustion temperature and that there be an adequate supply of oxygen. In view of this, fires are usually extinguished either by cooling the burning material or by excluding oxygen therefrom. Generally, fire-fighting equipment is designed to effect one or the other types of extinguishment effects. For example, large fighting fire equipment, such as conventional hoses and nozzles used for fighting large fires have straight nozzles which project a stream of water primarily for breaking up a fire and cooling. However, it has been found in some cases that better cooling effects can be obtained with fog nozzles. An example of such is disclosed in U.S. Pat. No. 2,726,897. By spraying a fire with a fog, a better cooling effect takes place and furthermore, the fog aides in the exclusion of oxygen. For small localized fires use has been of portable fire extinguishers of various types such as water, carbon dioxide, dry chemical and foam. The water extinguishers rely primarily on cooling while the others rely on excluding oxygen. Typically, water extinguishers can only be used on class A fires, i.e. fires in which paper, wood or the like are burning. However, fog can be used on some class B fires, i.e. oil fires, since fog cools over a large area and excludes air.

A type of fire extinguisher which has been found wide spread use is what is known as air/water fire extinguisher. Generally, such a fire extinguisher includes a tank containing about 2½ gallons of water under pressure. In order to discharge the water, a pickup tube extends from a valve with a pistol grip at the top of the tank to the bottom of the tank while a discharge hose extends from the valve exteriorly of the tank. The discharge hose is typically of ⅜ inch inner diameter which is fitted over a ⅜ inch outer diameter opening at the fire extinguisher valve. Usually, a nozzle is disposed on the end of the hose to direct a stream of water when the extinguisher is operated. Typically, the pressure, which is monitored by a pressure valve installed on the extinguisher, starts out at 160–180 PSI and decreases to zero PSI as the contents of the extinguisher are discharged.

Although such fire extinguishers have been used for many years, they suffer from a number of disadvantages. For example, see U.S. Pat. No. 1,168,015 which discloses such an extinguisher using carbon tetrachloride as the preferred liquid rather than water.

In many cases, water/air fire extinguishers containing a straight nozzle are not as effective as they might be. Consider, for example, a fire in a waste basket. To use the extinguisher, all of the burning area must be individually wetted. The water will tend to go to the bottom of the waste basket and burning in the upper portions may continue. Furthermore, because the water is directed in a straight stream from the extinguisher, the water is very quickly expended. If a larger fire is being fought, the problem becomes even more severe.

Accordingly, it is an object of the invention to provide an air/water extinguisher which is capable of forming a fog.

It is another object of the invention to provide a nozzle for a portable air/water fire extinguisher which can be easily retrofitted onto existing extinguishers.

Briefly, the invention provides a nozzle for use with a fire extinguisher of the type containing a liquid under pressure, a valve for discharging the liquid and a hose which extends from the valve. The nozzle has a cylindrical portion which is inserted into the end of the hose extending from the fire extinguisher and a rear portion containing a plurality of small holes for dispensing a plurality of streams of liquid to effect a fog spray.

In one embodiment, the nozzle consists of a cylindrical member of high impact plastic which contains a plurality of small holes at one end so as to break up a single stream of water into a plurality of fine streams to generate a fog. The head portion of the nozzle is of a diameter which is the same or not much larger than the inner diameter of the hose, thereby avoiding the need to build up large quantities of water within the nozzle and a resulting delay in operation. The nozzle may also be made of any other suitable material which is corrosion-resistant.

With the fog nozzle of the present invention, water is sprayed over a greater area of fire, bringing about better cooling and exclusion of air to more quickly extinguish the fire. Furthermore, because of the back pressure created by the nozzle, the contents are not expended nearly as quickly as in the case of a single-stream fire extinguisher. This gives a fire fighter more time to get at all of the fire. With a prior art nozzle providing only one stream, if the fire fighter misdirected his nozzle for only a few seconds a large percentage of the available water would be lost.

Although it has been thought that fog nozzles such as those used with holes require at least 100 PSI to operate effectively and that such were not applicable to air/water or other portable liquid extinguishers, it has been discovered that such nozzles are extremely effective and act to maintain the pressure within an extinguisher at a level which will result in a good fog until all of the water is expended.

These and other objects and advantages of the invention will become more apparent from the following detailed description and appended claims taken in conjunction with the accompanying drawings in which:

Figures 1, 2, 3, 4:
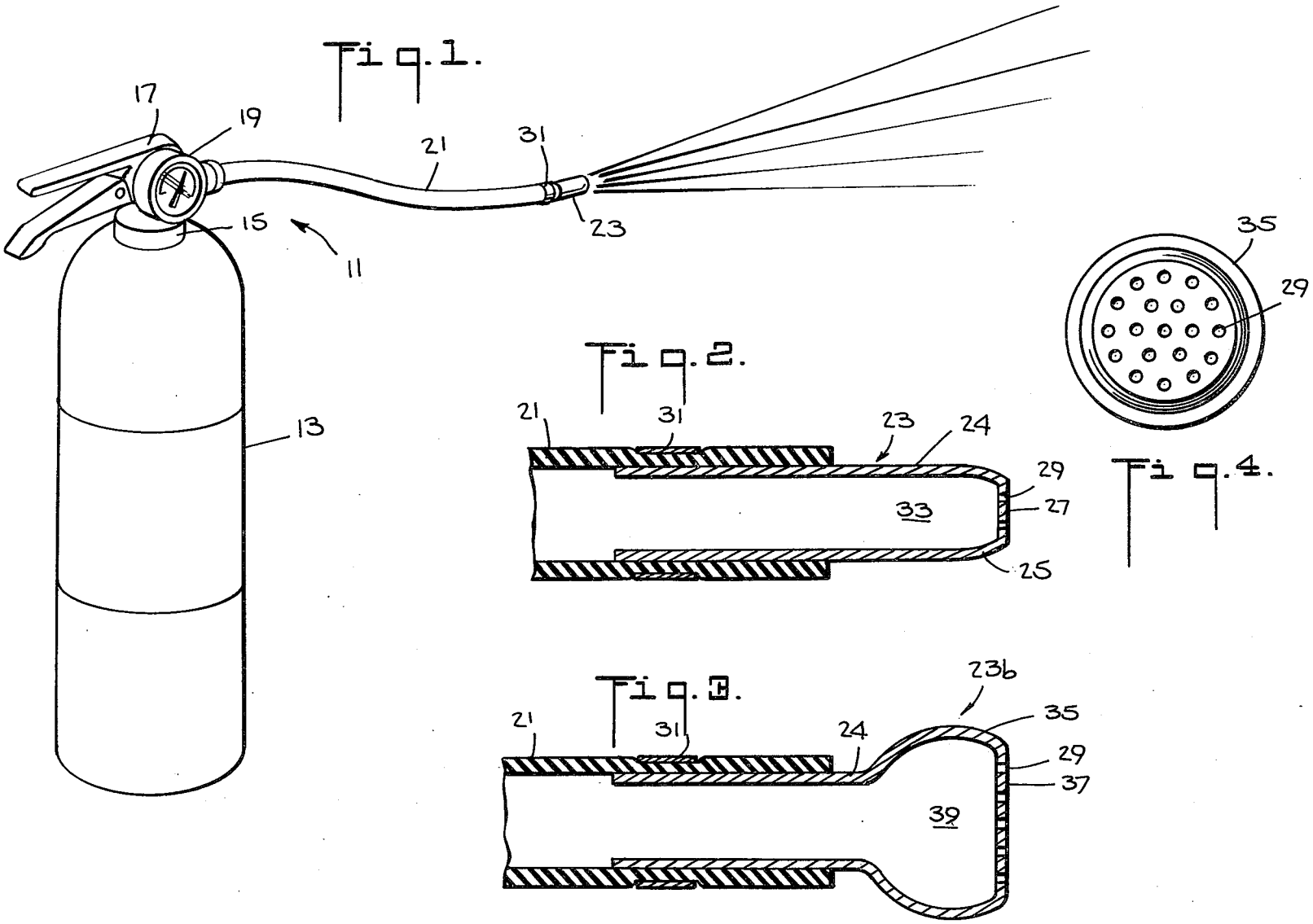
FIG. 1 illustrates a perspective view of a water/air fire extinguisher having a nozzle in accordance with the invention.
FIG. 2 illustrates a cross sectional view of a nozzle configuration according to the invention.
FIG. 3 illustrates a cross sectional view of a modified nozzle according to the invention.
FIG. 4 illustrates a front view of the nozzle of FIG. 2.

Referring to FIG. 1, the air/water fire extinguisher 11 includes a tank 13 which e.g. contains 2½ gallons of water or other suitable liquid. The tank 13 is pre-pressurized typically to between 160 and 180 PSI and terminates with a suitable fitting at the top 15 at which point a valve 17 containing a pistol grip, as is known, is provided. A gauge 19 is incorporated with the valve 17 to monitor for pressure loss and the need for recharging. The pistol grip typically will also include a pin (not shown) to prevent accidental discharge. In addition, a hose 21 extends from the valve 17. For that purpose, the valve 17 terminates with an outlet which is typically ⅜ inch OD while the hose 21 has an inner, or inside, diameter of ⅜ inches.

A nozzle 23 is disposed at the far end of the hose 21 which includes a cylindrical portion 24 defining an unobstructed flow path and a head portion 25. The nozzle 23 is made e.g. of high impact plastic or some other material which will not corrode or rust. The head portion 25 has a truncated conical section extending from the end of the cylindrical portion 21 and terminating at a planar member 27 containing a plurality of holes 29. The outer diameter of the cylindrical portion 24 is equal approximately to the inner diameter of the hose 21. Once the nozzle 23 is inserted in the hose 21, a band 31 is crimped in place to hold the nozzle 23 and prevent any leakage. Because the nozzle 23 is of a small diameter, the volume 33 of the nozzle which must be filled by water before spraying commences is small and a delay in obtaining a fog will not result.

Referring to FIG. 3, the nozzle 23*b* may alternatively be constructed with a cylindrical portion 24 as above and a head portion 35 which is enlarged and made up of a spherical portion attached on one side to the cylindrical portion 24 and at the other end with a planar member 37 containing a plurality of holes 29. This nozzle head portion 35 is of a larger size, but does not exceed two and one half times that of the inner diameter of the hose 21. With this nozzle 23*b* it is possible to form a greater number of holes 29 and thus, to obtain a wider spray or fog area. Because the size is still relatively small, the volume 39 within the head of the nozzle 23*b* will still be rapidly filled to give almost immediate fog action when put into use. A typical pattern of holes 29 is shown in FIG. 4. As illustrated, the hole pattern includes a central hole with additional holes being formed on concentric circles. The exact number of holes 29 and their spacing can vary depending on particular applications and the particular extinguisher with which the nozzle is used.

Referring to FIGS. 3 and 4, the hose 21 is $\frac{3}{8}$ inches in diameter O.D., the maximum diameter of the spherical head portion 35 is about $\frac{3}{4}$ inches, the diameter of the member 37 about $\frac{5}{8}$ inches. A total of nineteen holes 29 of about 3/64 inches in diameter are provided. In general, a range of 40 to 80 holes per square inch evenly distributed may be used. Hole size typically can be between 1/64 and 1/16 inches.

The nozzle is capable of being retrofitted on existing extinguishers 11 and may be supplied alone or equipped with a hose 21 which is then attached to the valve 17 of the extinguisher. As noted above, the re-equipping of such an extinguisher with the nozzle of the present invention will result in more efficient fire fighting due to the advantages of having a fog which spreads over a greater area to provide better cooling and oxygen exclusion. Furthermore, because of the ability of the fog nozzle to create a back pressure, the water is expelled more slowly, giving a fire fighter a better chance to cover the whole fire and extinguish it quickly.

It should be noted that although the nozzle of the present invention has been disclosed in combination with an air/water fire extinguisher, it is applicable to other types of extinguishers which utilize water or another liquid under pressure as the extinguishing agent. These and other modifications may be made without departing from the spirit of the invention which is intended to be limited solely by the appended claims.

What is claimed is:

1. In combination with a portable extinguisher having a tank containing a liquid under pressure, a valve mounted on a top of said tank and a flexible hose of predetermined inside diameter extending from said valve, a nozzle comprising a cylindrical portion disposed in one end of said hose to define a passage having an inside diameter substantially equal to said diameter of said hose and a head portion at one end of said cylindrical portion outside said hose, said head portion having a truncated conical section extending from said cylindrical portion and terminating in a member containing a plurality of holes distributed thereover for dispensing a plurality of streams of liquid to effect a fog spray, said member having a diameter less than said hose inner diameter.

2. The combination as set forth in claim 1 wherein said fire extinguisher is an air/water fire extinguisher.

3. A nozzle for use with a fire extinguisher of the type containing a liquid under pressure, said extinguisher including a valve for discharging the liquid and a flexible hose having an inside diameter of $\frac{3}{8}$ inch and extending therefrom, said nozzle comprising a cylindrical portion having an outer diameter essentially equal to the inner diameter of the hose for insertion of one end of said cylindrical portion into the hose and defining a passage having an inside diameter substantially equal to the inner diameter of the hose; and a head portion at an opposite end of said cylindrical portion terminating in a planar member containing therein a plurality of holes evenly distributed thereover for dispensing a plurality of streams of liquid to effect a fog spray, the diameter of said head portion having a diameter less than two and one half times the inner diameter of the hose.

4. The nozzle of claim 3 wherein said head portion comprises a truncated conical section extending from said cylindrical portion and terminating in said planar member with a diameter less than the hose inner diameter.

5. The nozzle of claim 3 wherein said head portion has the shape of a section of a sphere of a maximum diameter of $\frac{3}{4}$ inches, said head portion having one end attached to said cylindrical portion and the other end thereof terminating in said planar member, said head portion having a diameter greater than the hose inner diameter.

6. A hose and nozzle unit for use with a fire extinguisher containing a liquid under pressure comprising a flexible hose having a predetermined inside diameter, and a nozzle including a cylindrical portion disposed in one end of said hose to define a passage having an inside diameter substantially equal to said diameter of said hose; and a head portion at one end of said cylindrical portion outside said hose, said portion having a truncated conical section extending from said cylindrical portion and terminating in a planar member containing therein a plurality of holes distributed thereover for dispensing a plurality of streams of liquid to effect a fog spray; said planar member having a diameter less than the inside diameter of said hose.

7. The hose and nozzle unit of claim 6 and further including a metal band around said hose clamping said hose to said cylindrical portion of said nozzle.

8. A hose and nozzle unit for use with a fire extinguisher containing a liquid under pressure comprising a flexible hose having a predetermined inside diameter, and a nozzle including a cylindrical portion disposed in one end of said hose to define a passage having an inside diameter substantially equal to said diameter of said hose; and a head portion at one end of said cylindrical portion outside said hose having a diameter less than two and one half times the inside diameter of said hose, and the shape of a section of a sphere with one end attached to said cylindrical portion and the other end thereof terminating in a planar member containing a plurality of holes distributed thereover for dispensing a plurality of streams of liquid to effect a fog spray.

9. In combination with a portable extinguisher having a tank containing a liquid under pressure, a valve mounted on a top of said tank and a flexible hose of predetermined inside diameter extending from said valve, a nozzle comprising a cylindrical portion disposed in one end of said hose to define a passage having an inner diameter substantially equal to said diameter of said hose and a head portion at one end of said cylindrical portion outside said hose having a diameter less than two and one-half times the inside diameter of said hose and the shape of a section of a sphere with one end attached to said cylindrical portion and the other end thereof terminating in a member containing a plurality of holes distributed thereover for dispensing a plurality of streams of liquid to effect a fog spray.

* * * * *

UNITED STATES PATENT AND TRADEMARK OFFICE

CERTIFICATE OF CORRECTION

PATENT NO. : 4,154,304

DATED : May 15, 1979

INVENTOR(S) : Henry Steibing et al

It is certified that error appears in the above-identified patent and that said Letters Patent are hereby corrected as shown below:

Column 4, line 54, after second "said" second occurrence insert --head--.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*